US005533357A

United States Patent [19]

Voorhis

[11] Patent Number: 5,533,357

[45] Date of Patent: Jul. 9, 1996

[54] AIR CONDITIONING APPARATUS

[75] Inventor: Roger J. Voorhis, Pennellville, N.Y.

[73] Assignee: Carrier Corporation, Syracuse, N.Y.

[21] Appl. No.: 393,147

[22] Filed: Feb. 15, 1995

[51] Int. Cl.[6] ..... F25B 29/00

[52] U.S. Cl. ..... 62/277; 62/324.5

[58] Field of Search ..... 62/325, 324.1, 62/324.5, 277, 279, 283

[56] References Cited

U.S. PATENT DOCUMENTS

| | | | |
|---|---|---|---|
| 1,942,295 | 1/1934 | Kerr et al. | 62/6 |
| 2,213,347 | 9/1940 | Neeson | 62/279 |
| 2,216,427 | 10/1940 | Arnold et al. | 62/140 |
| 2,293,482 | 8/1942 | Ambrose | 62/6 |
| 2,984,087 | 5/1961 | Folsom | 62/325 |
| 3,301,003 | 1/1967 | Laing | 62/324.5 |
| 3,447,335 | 6/1969 | Ruff | 62/159 |
| 3,995,446 | 12/1976 | Eubank | 62/325 |
| 4,424,686 | 1/1984 | Lapeyre et al. | 62/259.1 |

FOREIGN PATENT DOCUMENTS

| | | | |
|---|---|---|---|
| 184843 | 11/1982 | Japan | 62/325 |
| 3207937 | 9/1991 | Japan | 62/325 |

*Primary Examiner*—Henry A. Bennett

*Assistant Examiner*—William C. Doerrler

[57] ABSTRACT

An air conditioning apparatus for both heating and cooling an enclosed space. The apparatus employs a vapor compression refrigeration system in which the flow of refrigerant through the inside and outside heat exchangers is the same in both cooling and heating modes. The alignment of an arrangement of dampers determine whether air from the space passes through the evaporator section of the apparatus (during operation in the cooling mode) or through the condenser section (during operation in the heating mode). The same damper arrangement reconfigures the flow of outside air from the condenser section to the evaporator section on a shift from cooling to heating mode operation. The apparatus is entirely contained within a single enclosure intended for installation in an exterior wall of the structure that it serves. The evaporator section is located above the condenser section in the enclosure so that the area occupied by the apparatus is minimized and also so that water condensate that forms on the evaporator can drain by gravity to the condenser where it can be re-evaporated and carried out of the enclosure by the air passing through the condenser. The apparatus has operating modes that accelerate the removal of frost that may form on the evaporator during heating mode operation and that supply outside air and exhaust inside air from the enclosed space. The compressor and blowers of the apparatus may be of the type that can operate at more than one speed.

5 Claims, 4 Drawing Sheets

AIR CONDITIONING APPARATUS

BACKGROUND OF THE INVENTION

This invention relates generally to the field of air conditioning. More particularly the invention relates to an apparatus for both heating and cooling an enclosed space with an air source closed loop vapor compression refrigeration system.

Air source vapor compression refrigeration systems have long been used both to cool and heat enclosed spaces. Such systems that both heat and cool are commonly called heat pumps. The principles of operation of heat pumps are well known. In an air source system, air is the source of heat for evaporating refrigerant in the system evaporator and also the heat sink for condensing refrigerant in the system condenser. When it is desired to cool the space, air is drawn from the space, caused to flow though the system evaporator where it is cooled, and then returned to the space. When it is desired to heat the space, air is drawn from the space, caused to flow through the system condenser where it is heated, and then returned to the space. In an air source system, air from outside the enclosed space is the source of heat for heating and the heat sink for cooling.

Shifting a heat pump between cooling and heating modes may be accomplished in one of two ways. One way is to keep the air flow paths the same and to reverse the flow of refrigerant through the inside and outside heat exchangers so that they trade functions on a mode change, that is, the inside heat exchanger, the evaporator during operation in the cooling mode, becomes the condenser during operation in the heating mode while the outside heat exchanger similarly changes functions. Another way to shift modes is to shift air flows. In a system using this method, the refrigerant flow is the same in both modes with one heat exchanger thus functioning as the evaporator and the other as the condenser for both heating and cooling. The air flow paths shift on a mode change so that inside air flows through the evaporator during operation in the cooling mode and through the condenser during operating in the heating mode while outside air flow similarly shifts between heat exchangers.

There are some disadvantages to mode shifting by reversing system refrigerant flow. First, a flow reversing valve is necessary. Second, there must be either an additional expansion device or there must be another device that is capable of causing refrigerant expansion in both directions of refrigerant flow. Third, a heat exchanger in a flow reversing system must be capable of functioning as both a condenser and an evaporator. The configuration of such a heat exchanger must necessarily be a compromise between the differing designs for an optimal condenser and an optimal evaporator. All these factors may result in increased cost for such a reversible system. In addition, the flow reversing valve may be a source of noise when it repositions when shitting modes.

There are numerous examples in the prior art of vapor compression heat pump systems in which the mode shift from cooling to heating is accomplished by shifting air flows. Among these are U.S. Pat. No. 1,942,296, issued 2 Jan. 1934 to Kerr et al., U.S. Pat. No. 2,216,427, issued 1 Oct. 1940 to Arnold et al., U.S. Pat. No. 2.293,482, issued 18 Aug. 1942 to Ambrose, U.S. Pat. No. 2,984,087, issued 16 May 1961 to Folsom, U.S. Pat. No. 3,447,335, issued 3 Jun. 1969 to Ruff et al. and U.S. Pat. No. 3,995,446, issued 7 Dec. 1976 to Eubank. The present invention differs from all of the cited prior art references in the arrangement and function of its dampers.

The space in a building required for installation of a heating and air conditioning system is always a consideration. Designers usually strive to make such systems as compact as possible. The system "footprint" or amount of floor space required is particularly important. The footprint problem is very significant in small structures such as mobile homes. There must be a source of outside air for one of the heat exchangers in an air source air conditioning system. In the typical residential "split" air conditioning system, this is accomplished by locating the condenser in a separate enclosure outside the building. This arrangement has disadvantages, especially in structures like portable buildings and mobile homes.

High temperatures in many locations are accompanied by high humidity. When an air conditioning system is operating in the cooling mode in these locations, condensate forms on the system evaporator. A properly designed system must have means for disposing of this condensate. In cooler weather, when a heat pump is operating in the heating mode, frost can form on the evaporator and adversely effect system performance. A properly designed system must have means for defrosting the evaporator.

SUMMARY OF THE INVENTION

The present invention is an air conditioning system for both heating and cooling an enclosed space. The system uses a vapor compression heat pump in which the flow of refrigerant is the same in both heating and cooling modes of operation. The alignment of an arrangement of dampers determine whether air from the space passes through the evaporator section of the apparatus (during operation in the cooling mode) or through the condenser section (during operation in the heating mode). The same damper arrangement reconfigures the flow of outside air from the condenser section to the evaporator section on a shift from cooling to heating mode operation The system has two defrost modes of operation in which the evaporator can be warmed for a short time to remove frost. A passive defrost mode is used when the outside air temperature is above about 5° C. An active defrost mode is used when the outside air temperature is below that temperature. The system can also have a ventilation mode in which fresh outside air can be supplied to the enclosed space and air from the space exhausted.

The system is entirely self-contained within a single enclosure so that a separate outside unit is not required. The evaporator and condenser are located in an "over and under" configuration so that the enclosure footprint is kept to a minimum. The enclosure could be mounted in an outside wall of a structure so that it occupies little or no floor space inside the structure.

Condensate drainage from the evaporator, which is located over the condenser, is directed to the condenser by simple gravity flow. The heat from the condenser evaporates the condensate. In cooling mode operation the evaporated condensate is carried to the outside by the air flowing through the condenser. In defrost mode operation, the condensate that re-evaporates on the condenser is carried into space served. The moisture added to the inside air will raise relative humidity, which is usually lower than desirable inside a heated structure in cold weather.

The compressor and blowers of the system can be of the type that can operate at more than one speed including operating over a range of speeds so that increased system operating efficiency can be obtained.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
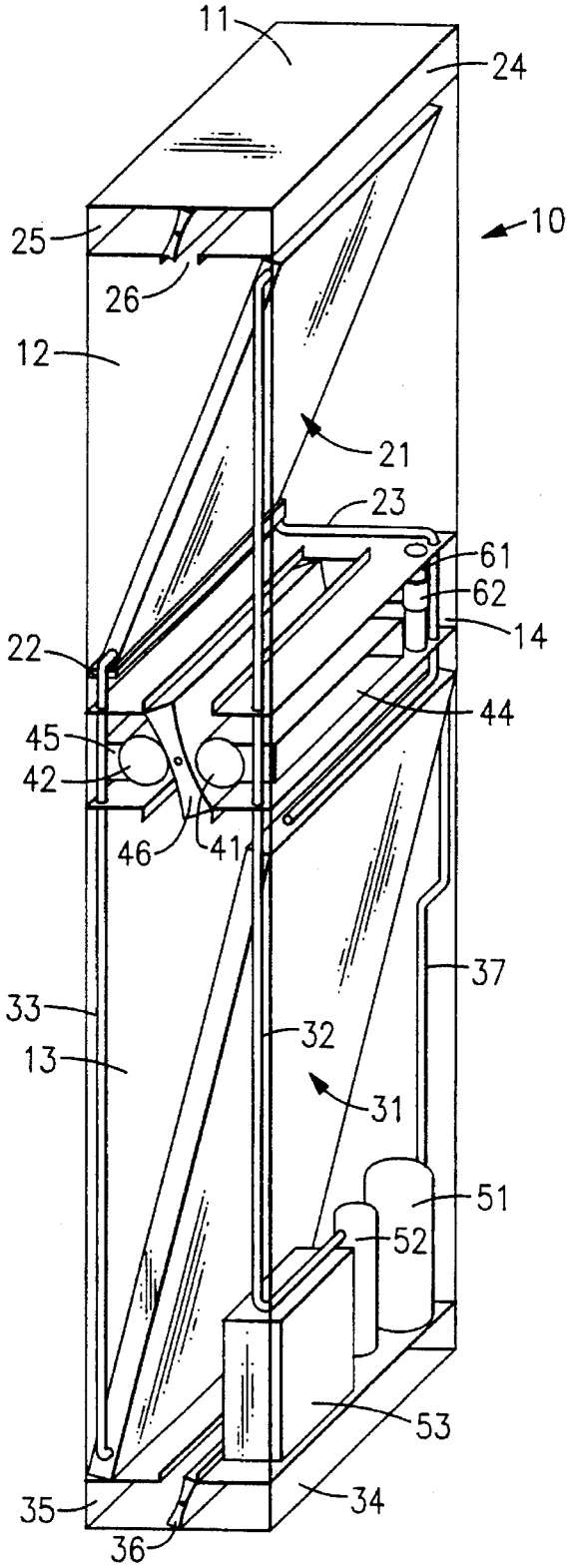
FIG. 1 is an isometric view of the air conditioning apparatus, with a side and the front panels removed, of the present invention

FIG. 1 depicts apparatus 10 of the present invention. In the figure, the front and a side panel are not shown so that internal components are visible. The entire apparatus is contained in a single enclosure 11. Enclosure 11 has three sections, upper or evaporator section 12, lower or condenser section 13 and middle or blower section 14.

Mounted in upper section 12 are evaporator 21 and upper damper 26. Air from the space to be conditioned can enter upper section 12 through upper inside air inlet 24. Air from outside the space to be conditioned can enter upper section 12 through upper outside air inlet 25. Damper 26 is a two position damper. In a first position (Position 1), damper 26 allows air to flow through air inlet 24 and prevents air flow through air inlet 25. In a second position (Position 2), damper 26 allows air to flow through air inlet 25 and prevents air flow through air inlet 24.

Mounted in lower section 13 are condenser 31 and lower damper 36. Air from the space to be conditioned can enter lower section 13 through lower inside air inlet 34. Air from outside the space to be conditioned can enter lower section 13 through lower outside air inlet 35. Damper 36 is a two position damper. In a first position (Position 1 ), damper 36 allows air to flow through air inlet 35 and prevents air flow through inlet 34. In a second position (Position 2), damper 26 allows air to flow through air inlet 34 and prevents air flow through air inlet 35. Also mounted in lower section 13 are compressor 51, accumulator 52 and control module 53.

Mounted in middle section 14 are first blower 41, second blower 42 and middle damper 46. Blower 41 exhausts air from enclosure 10 to the space to be conditioned through inside air outlet 44. Blower 42 exhausts air from enclosure 10 to the outside through outside air outlet 45. Damper 46 is a three position damper. In a first position (Position 1), first blower 41 draws air from upper section 12 and discharges it through air outlet 44 and blower 42 draws air from lower section 13 and discharges it through air outlet 45. In a second position (Position 2), blower 41 draws air from lower section 13 and discharges it through air outlet 44 and blower 42 draws air from upper section 12 and discharges it through air outlet 45. In a third position (Position 3), allows blower 41 to draw air from both upper section 12 and lower section 13 and discharge it to air outlet 44.

Middle damper 46 prevents air from flowing between upper section 12 and lower section 13 while that damper is in its Positions 1 and 2 (see above). Active defrost duct 61 provides a flow path for air between upper section 12 and lower section 13 regardless of the position of damper 46. Active defrost duct damper 62 is located in active defrost duct 61. Active defrost duct damper 62 is a two position damper. In a first position (Shut), it prevents air flow through active defrost duct 61. In a second position (Open), it allows air flow throughout active defrost duct 61.

Suction gas line 32 provides a flow path for refrigerant between evaporator 21 and accumulator 52. Discharge gas line 37 provides a flow path for refrigerant between compressor 51 and condenser 31. Liquid line 33 provides a flow path for refrigerant between condenser 31 and expansion device 22. Expansion device 22 is connected to evaporator 21 and accumulator 52 is connected to compressor 51. There is therefore a closed refrigerant flow loop from the discharge of compressor 51 to condenser 31 to expansion device 22 to evaporator 21 to accumulator 52 to the suction of compressor 51, all in a configuration well known in the art.

Condensate drain system 23 collects condensate draining from evaporator 21, conveys the condensate, by gravity flow, from upper section 12 to lower section 13 and disperses the condensate on to condenser 31.

Figure 2:
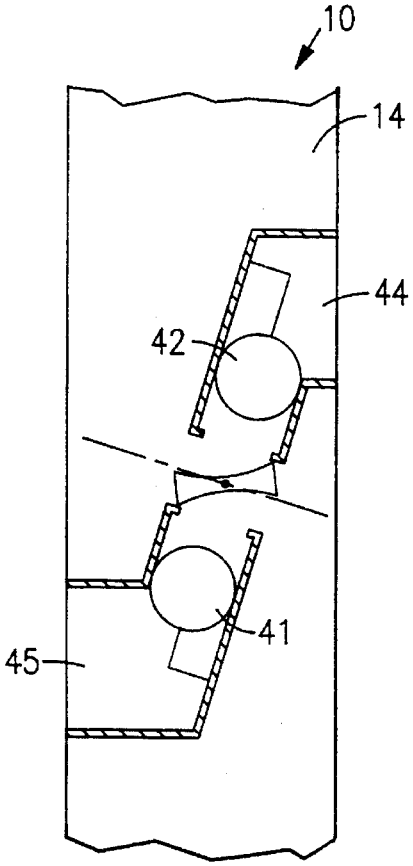
FIG. 2 is a side view of a portion of an alternative embodiment of the air conditioning apparatus of the present invention.

FIG. 2 shows alternative arrangement of middle section 14. In that arrangement, first and second blowers 41 and 42 are not mounted in the same horizontal plane but rather one is over and offset from the other. In this way it may be possible for enclosure 10 to be thinner than if the arrangement of the middle section is as shown in FIG. 1.

The system of the present invention can operate in several different modes. FIGS. 3A through 3E show schematically the air flow through enclosure 11 when operating in the various modes. For purposes of clarity, the figures show active defrost duct 61 as extending externally out from a wall of enclosure 11. That configuration is possible but not necessary nor desirable.

Figure 3A:
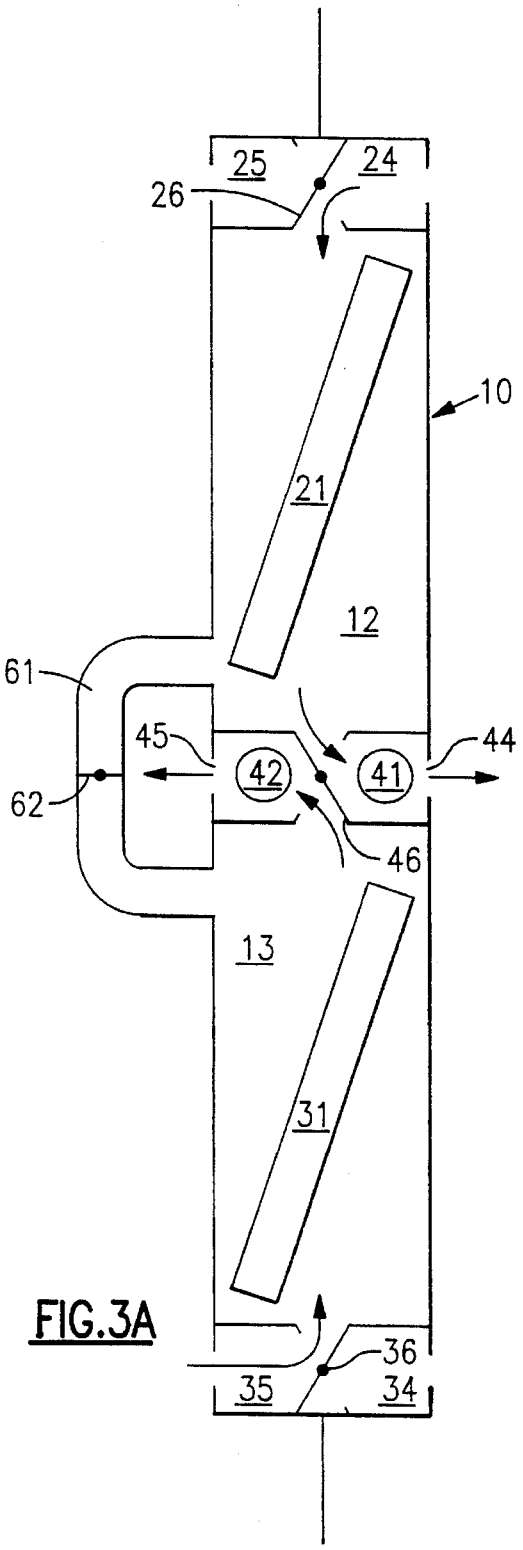
FIGS. 3A through 3E are schematic diagrams of the air flow through the air conditioning apparatus of the present invention while operating in different modes of operation.

FIG. 3A shows the system operating in the cooling mode. Compressor 51 and both blower 41 and blower 42 are operating, dampers 26, 36 and 46 are in their respective Positions 1 and damper 61 is Shut. Blower 41 draws air from the space being cooled into upper section 12 through air inlet 24, through evaporator 21 and returns the air to the space through air outlet 44. Blower 42 causes a flow of air from the outside into lower section 13 through air inlet 35, through condenser 31 and returns the air to the outside through air outlet 45. In this mode, evaporator 21 cools the inside air and outside air cools condenser 31.

Figure 3B:
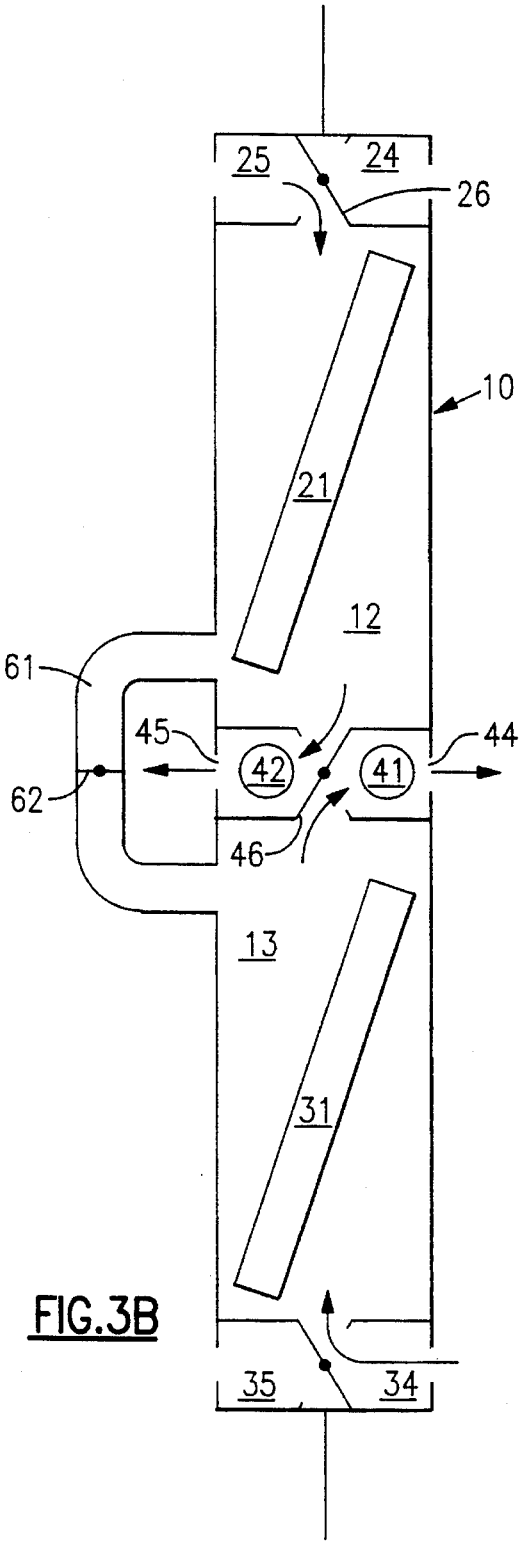

FIG. 3B shows the system operating in the heating mode. Compressor 51 and both blower 41 and blower 42 are operating, upper, lower and middle dampers 26, 36 and 46 are in their respective Positions 2 and active defrost duct damper 62 is Shut. Blower 42 draws air from the outside into upper section 12 through air inlet 25, through evaporator 21 and returns the air to the outside through air outlet 45. Blower 41 draws air from the space being heated into lower section 13 through air inlet 34, through condenser 31 and returns the air to the space through inside air outlet 44. In this mode, condenser 31 heats the inside air and the outside air heats evaporator 21.

Figure 3C:
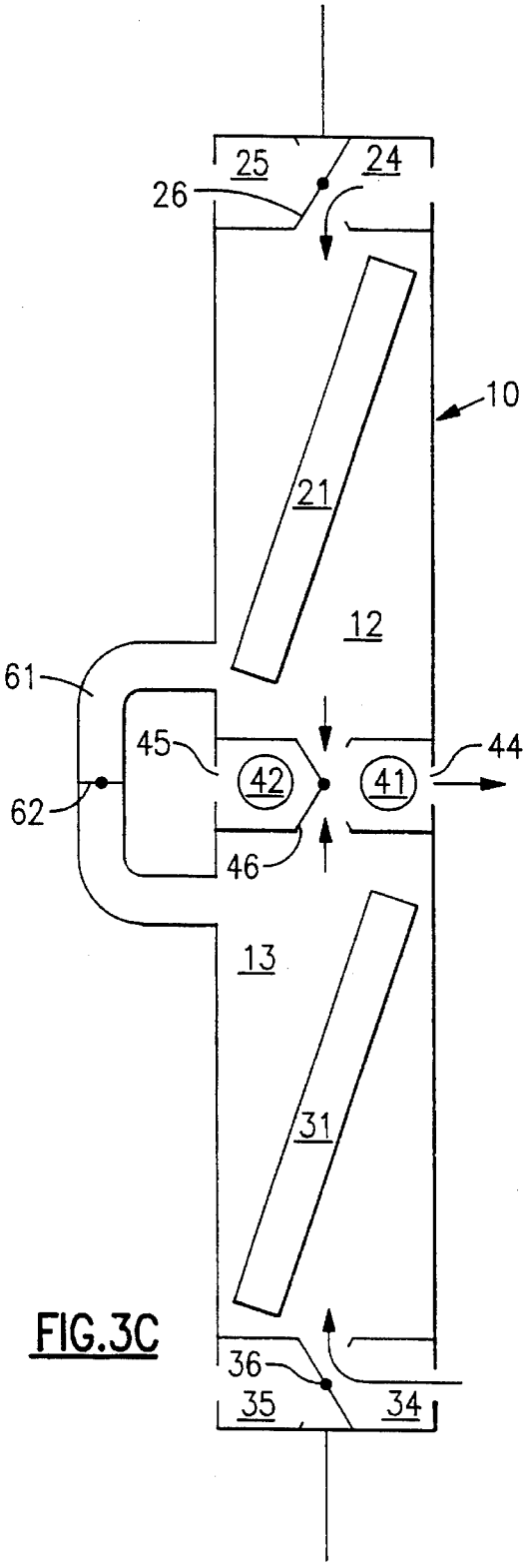

FIG. 3C shows the system operating in the passive defrost mode. Compressor 51 is not operating, blower 41 is operating, blower 42 is not operating, upper damper 26 is in its Position 1, lower damper 36 is in its Position 2, middle damper 46 is in its Position 3 and active defrost duct damper 62 is Shut. Blower 41 draws air from the space being heated into upper section 12 through air inlet 24, through evaporator 21 and returns the air to the space through air outlet 44. Blower 41 also draws air from the space being heated into lower section 13 through air inlet 34, through condenser 21 and returns the air to the space through inside air outlet 44.

In this mode, warm inside air melts frost that may have formed on evaporator 21. Operation in this mode can defrost the evaporator in a reasonable time when the outside air temperature is above about 5° C.

Figure 3D:
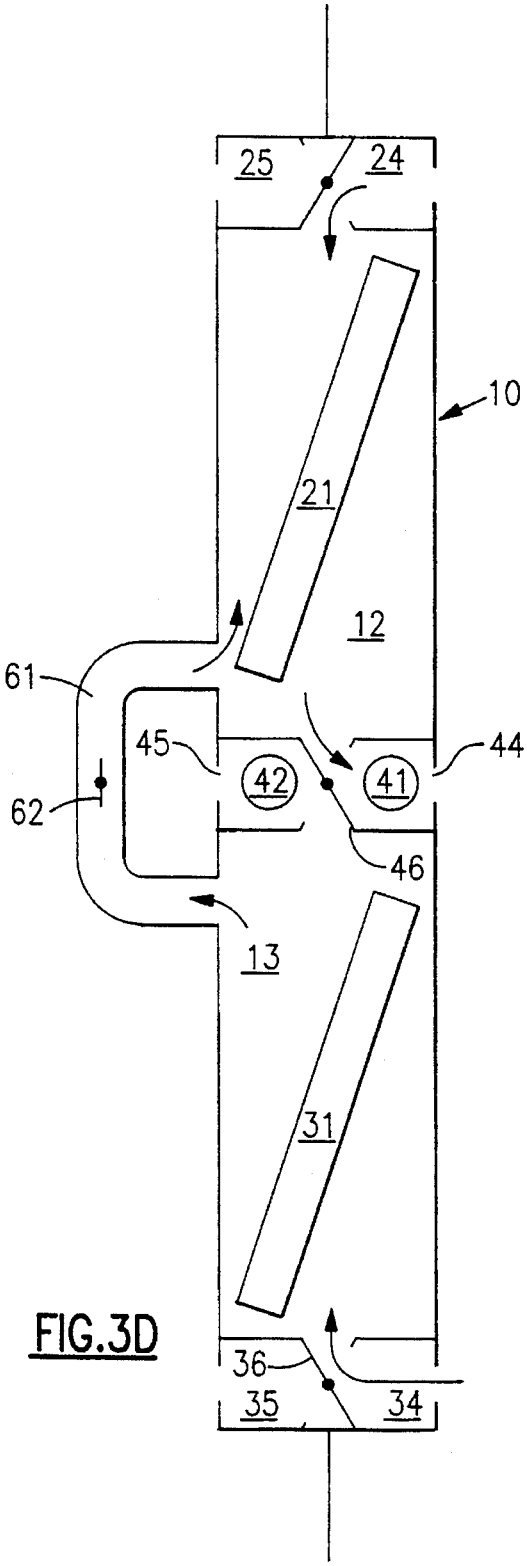

FIG. 3D shows the system operating in the active defrost mode. Compressor 51 is operating, both blower 41 and blower 42 are operating, or blower 42 could be in the off mode as illustrated in FIG. 3D upper damper 26 is in its Position 1, lower damper 36 is in its Position 2, middle damper 46 is in its Position 1 and active defrost duct damper 61 is Open. Blower 41 draws air from the space being heated into upper section 12 through air inlet 24, through evaporator 21 and returns the air to the space through air outlet 44. Blower 41 also draws air from the space being heated into lower section 13 through air inlet 34, through condenser 31 and then into upper section 12 through active defrost duct 61. In this mode, air warmed by condenser 31 assists warm inside air in melting any frost that may have formed on evaporator 21. Operation in this mode can defrost the evaporator in a reasonable time when the outside air temperature is below about 5° C.

Figure 3E:
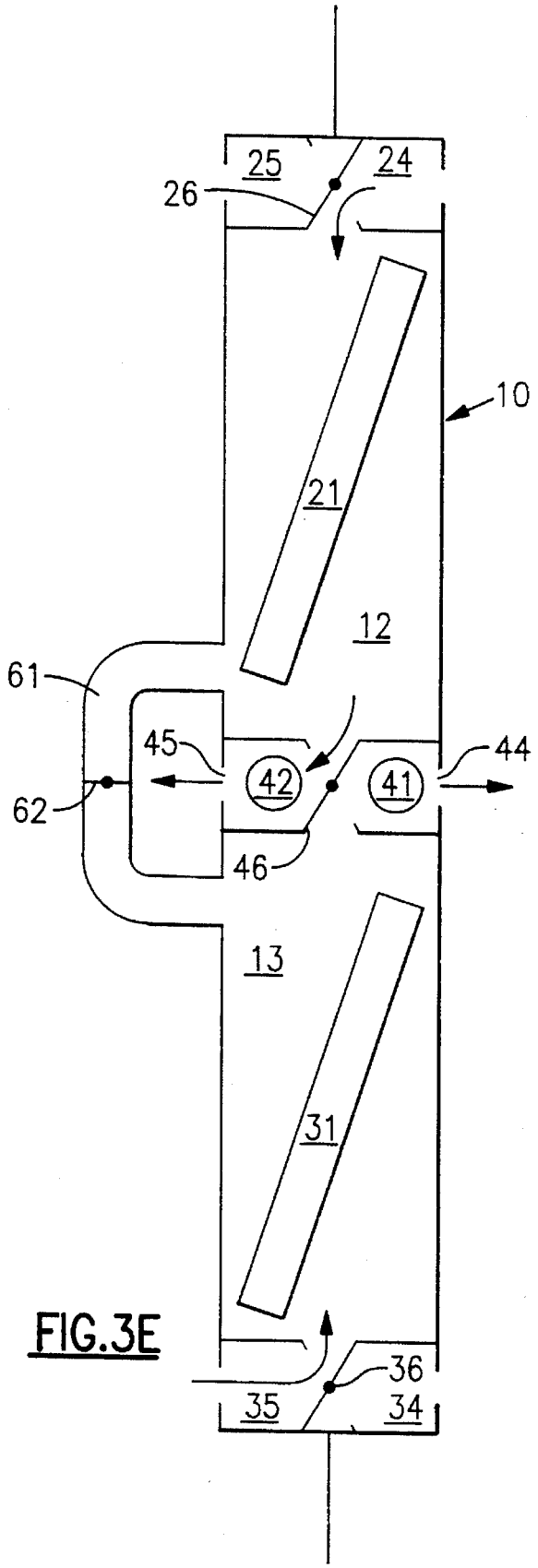

FIG. 3E shows the system operating in the ventilation mode. Compressor 51 is not operating, both blower 41 and blower 42 are operating, upper damper 26 is in its Position 1, lower damper 36 is in its Position 2, middle damper 46 is in its Position 2 and active defrost duct damper 62 is Shut. Blower 42 draws air from the space being ventilated into upper section 12 through inside air inlet 24, through evaporator 21 and exhausts the air to the outside through air outlet 45. Blower 41 draws air from the outside into lower section 13 through air inlet 35, through condenser 21 and supplies it to the space through air outlet 44. In this mode, blower 41 exhausts air from the enclosed space to the outside and blower 42 supplies outside air to the enclosed space.

Module 53 contains the necessary electrical controls to position dampers (through electromechanical actuators), either start or not start and stop the compressor and blowers in response to stored programming, inputs from a thermostat and possibly other sensors and user settings. The module may also have the controls and programming necessary to operate the system at more than one compressor and blower operating speeds, including the capability to operate the system over a range of speeds.

An air conditioning apparatus constructed according to the teaching of the present invention and having a cooling and heating capacity of about 10 to 11 kilowatts could fit into a single enclosure measuring approximately 60 centimeters wide, 30 centimeters deep and 1.8 meters high. An enclosure of that size could easily be installed through an exterior wall of most common structures. The apparatus of the present invention therefore provides for both heating and cooling a space in a single, compact package. Energy savings and noise reduction can be achieved if the compressor and blowers of the apparatus have the capability of operating at more than one speed.

I claim:

1. An apparatus (10) for conditioning the air of an enclosed space comprising:

an air source vapor compression refrigeration system having
- a compressor (51),
- a condenser (31),
- an expansion device (22), and
- an evaporator (21), all interconnected in a closed refrigerant flow loop;

an apparatus enclosure (11) having an upper section (12) containing said evaporator and having
- an upper inside air inlet (24) in upstream air flow relationship with said evaporator,
- an upper outside air inlet (25) in downstream air flow relationship with said evaporator, and
- an upper damper (26), proximate to and controlling the flow of air through said upper inside air inlet and said upper outside air inlet, having
  - a first position in which said upper damper allows air flow only through said upper inside air inlet, and
  - a second position in which said upper damper allows air flow only through said upper outside air inlet, a lower section (13) containing said condenser and having
- a lower inside air inlet (34) in upstream air flow relationship with said condenser,
- a lower outside air inlet (35) in downstream air flow relationship with said condenser, and
- a lower damper (36), proximate to and controlling the flow of air through said lower inside air inlet and said lower outside air inlet, having
  - a first position in which said lower damper allows air flow only through said lower outside air inlet, and
  - a second position in which said lower damper allows air flow only through said lower inside air inlet, and a middle section (14) containing
- a first air outlet (44) for supplying conditioned air to said space,
- a second air outlet (45) for discharging air to the outside,
- a first blower (41) in upstream air flow relationship with said first air outlet,
- a second blower (42) in upstream air flow relationship with said second air outlet, and
- a middle damper (46) having
  - a first position in which said middle damper allows said first blower to move air from said upper section to said first air outlet and said second blower to move air from said lower section to said second air outlet,
  - a second position in which said middle damper allows said first blower to move air from said lower section to said first air outlet and said second blower to move air from said upper section to said second air outlet, and
  - a third position in which said middle damper allows said first blower to cause a flow of air from both said lower and said upper sections to said first air outlet; and means (53) for controlling said apparatus for operation in each of the following operating modes:

a cooling mode in which said upper, lower and middle dampers are in their respective said first positions, a heating mode in which said upper, lower and middle dampers are in their respective said second positions:

a defrost air duct (61) extending from said lower section to said upper section; and a defrost air duct damper (62) in said defrost air duct that has
- a first position in which said defrost air duct prevents air flow through said defrost air duct, and a second position in which said defrost air duct allows air flow through said defrost air duct;

and in which said control means further comprises means for configuring said apparatus for operation in an active defrost mode in which said upper damper and said lower damper are in their respective said first and second positions, said middle damper is in its said first position, and said active defrost duct damper is in its said second position.

2. The apparatus of claim 1 in which said control means further comprises means for configuring said apparatus for operation in a passive defrost mode in which said upper damper is in its said first position, said lower damper is in its said second position and said middle damper is in its said third position.

3. The apparatus of claim 1 in which said control means further comprises means for configuring said apparatus for operation in a ventilation mode in which said upper damper and said lower damper are in their respective said first positions, and said middle damper is in its said second position.

4. The apparatus of claim 1 in which said control means further comprise means for operating said compressor at more than one speed.

5. The apparatus of claim 1 further comprising drainage means (23) for collecting condensate draining from said evaporator in said upper section, conducting condensate through said middle section and delivering and dispersing condensate to and over said condenser in said lower section.

* * * * *